US008375931B2

(12) United States Patent
Casas Salva

(10) Patent No.: US 8,375,931 B2
(45) Date of Patent: Feb. 19, 2013

(54) COMPRESSED GAS OPERATED FIREARM

(75) Inventor: Francisco Casas Salva, Barcelona (ES)

(73) Assignee: Industrias el Gamo, SA, Barcelona (ES)

( * ) Notice: Subject to any disclaimer, the term of this patent is extended or adjusted under 35 U.S.C. 154(b) by 471 days.

(21) Appl. No.: 11/840,049

(22) Filed: Aug. 16, 2007

(65) Prior Publication Data

US 2012/0118276 A1 May 17, 2012

(51) Int. Cl.
*F41B 11/06* (2006.01)

(52) U.S. Cl. ..... 124/71

(58) Field of Classification Search ..... 42/13, 10, 42/28, 75.04, 46, 40, 34, 76.01, 54, 8, 75.01, 42/77; 124/71, 63, 66; 102/502
See application file for complete search history.

(56) References Cited

U.S. PATENT DOCUMENTS

| | | | | |
|---|---|---|---|---|
| 34,806 | A | 3/1862 | Budd | |
| 44,312 | A * | 9/1864 | Hillis | 42/40 |
| 230,224 | A * | 7/1880 | Beebe | 42/77 |
| 2,368,029 | A | 1/1945 | Knight | |
| 3,465,744 | A * | 9/1969 | Nielsen | 124/27 |
| 5,363,769 | A * | 11/1994 | Bellak et al. | 102/446 |
| 5,979,330 | A | 11/1999 | Cornell | |
| 7,156,085 | B2 * | 1/2007 | Lewis et al. | 124/66 |
| 7,207,273 | B2 * | 4/2007 | Brunn | 102/450 |
| 7,526,998 | B2 * | 5/2009 | Vasel et al. | 102/502 |

* cited by examiner

*Primary Examiner* — Bret Hayes
*Assistant Examiner* — Reginald Tillman, Jr.
(74) *Attorney, Agent, or Firm* — Kilpatrick Townsend & Stockton LLP

(57) ABSTRACT

A compressed gas firearm is capable of firing either cartridges filed with pellets, or solid unitary projectiles. The firearm includes a barrel that is hinged to the butt so that cartridges or an adapter can be inserted into the end of the barrel. A compressed gas chamber in the butt is capable of releasing compressed gas against the rear of the cartridge or adapter to fire the pellets or the unitary projectile. When the adapter is inserted into the barrel, a projectile can then be inserted into the adapter before the barrel is closed for firing. Indentations may be formed in the rear of the barrel to facilitate removal of the cartridges or adapter.

23 Claims, 8 Drawing Sheets

COMPRESSED GAS OPERATED FIREARM

BACKGROUND

1. Field

The disclosure relates to a compressed gas operated firearm. More particularly, the disclosure relates to a firearm that is capable of firing pellets or a solid projectile.

2. Background

U.S. Pat. No. 34,806, dated 1862, discloses a method of forming fixed charges of shot which can then be used in a firearm with or without wrappers. The method involves putting shot pellets in a mold, and pouring among the shot, while in a mold, some easily-fusible material such as ace grease, stearine, etc. Upon cooling, the material will fix the shot, and, when discharged from the mold, will retain said shot in the form it assumed in the mold.

U.S. Pat. No. 2,368,029, dated 1941, discloses a shot shell having a metallic base and a cylindrical casing attached to the base. A propellant charge is put in the base, and a projectile charge is placed in the cylindrical casing. Means are provided to separate the propellant charge in the base from the projectile charge in the casing. Such means comprising a series of driving wads, an overshot wad associated with the end of the casing and adapted to retain the projectile charge in the casing and tracer projectiles attached to the outer surface of the overshot wad.

U.S. Pat. No. 5,979,330, dated 1998, discloses a shotgun shell wad that is used in a shotgun shell. Three discs disposed within the generally cylindrical tubular wall define a seal gas section, a middle section, a shot cup extension section, and a shot cup section. The third disc, which separates the shot cup extension section and the shot cup section, is detachably connected to the tubular wall such that when the shell is fired, the third disc breaks away and travels rearward relative to the rest of the shot shell wad to a position adjacent to the second disc. A plurality of fingers defined by a plurality of lateral cuts through the tubular wall in the shot cup section extend from a point in the shot cup section to the forward tubular end of the wall. The wall also includes a plurality of cuts passing therethrough lateral substantially at the point where the plurality of cuts terminate. Circumferential, the plurality of cuts extend through a section of each of the plurality of fingers. A plurality of lateral ridges extend inwardly from the tubular wall from substantially the point where the plurality of lateral cuts terminate to substantially the forward tubular end of the wall and are positioned at substantially the to center of each of the plurality of fingers.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings, in which like reference numerals refer to like elements, and wherein.

DETAILED DESCRIPTION

The firearm disclosed in this application can be used to file pellets or solid projectiles. The pellets would be loaded into a pellet cartridge similar to a typical shotgun shell. When such a pellet cartridge is used, the firearm would operate much like a traditional shotgun, although the pellets would be propelled by compressed gas, instead of an explosive charge.

The same firearm can also be used to fire solid projectiles. An adapter would be used to fire a solid projectile. The adapter would resemble a typical shotgun shell, and the adapter would be loaded into the barrel of the firearm in the same basic manner as the pellet cartridge.

Figure 1:
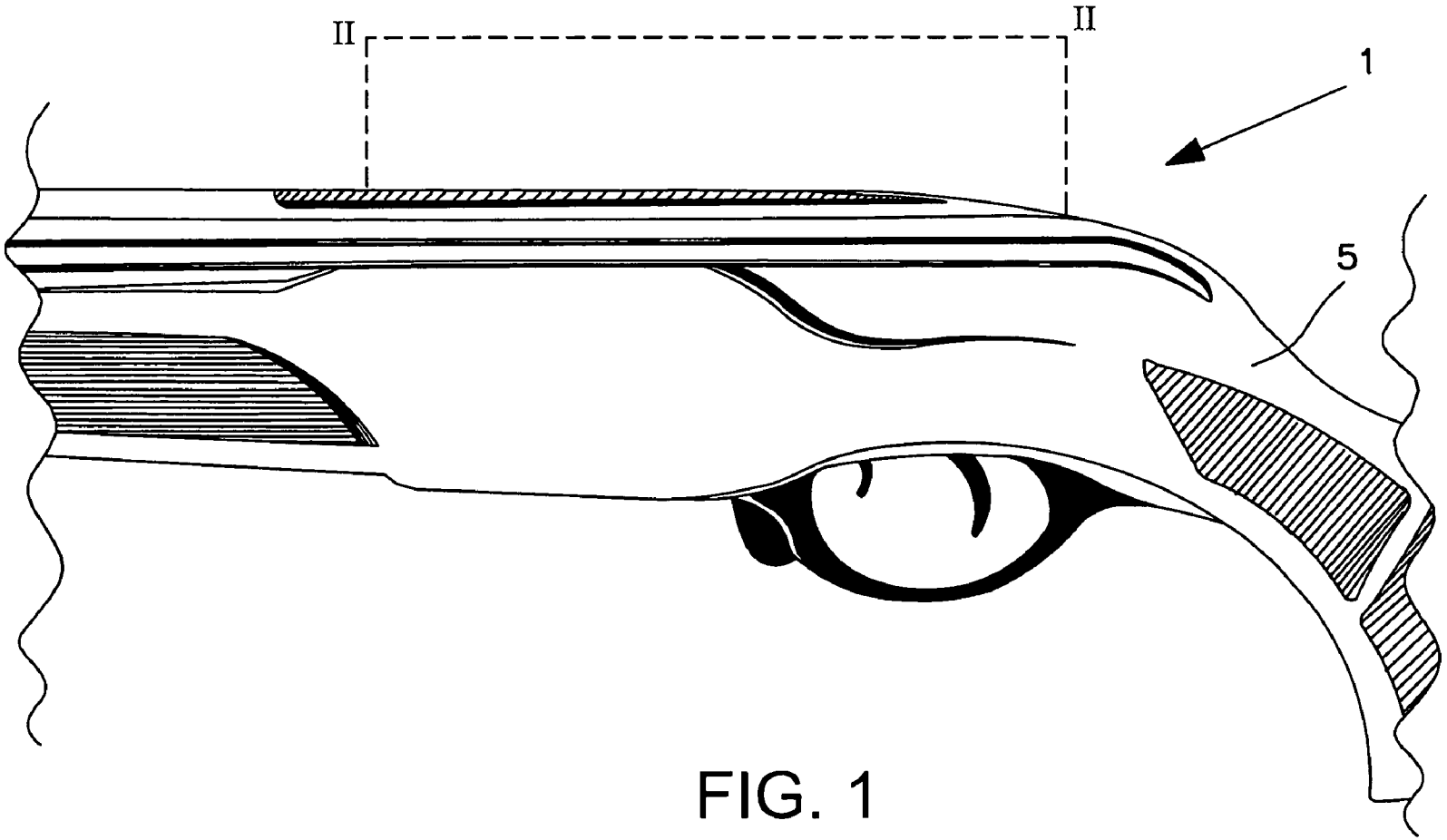
FIG. 1 is a partial perspective view of a firearm.
Figure 2:
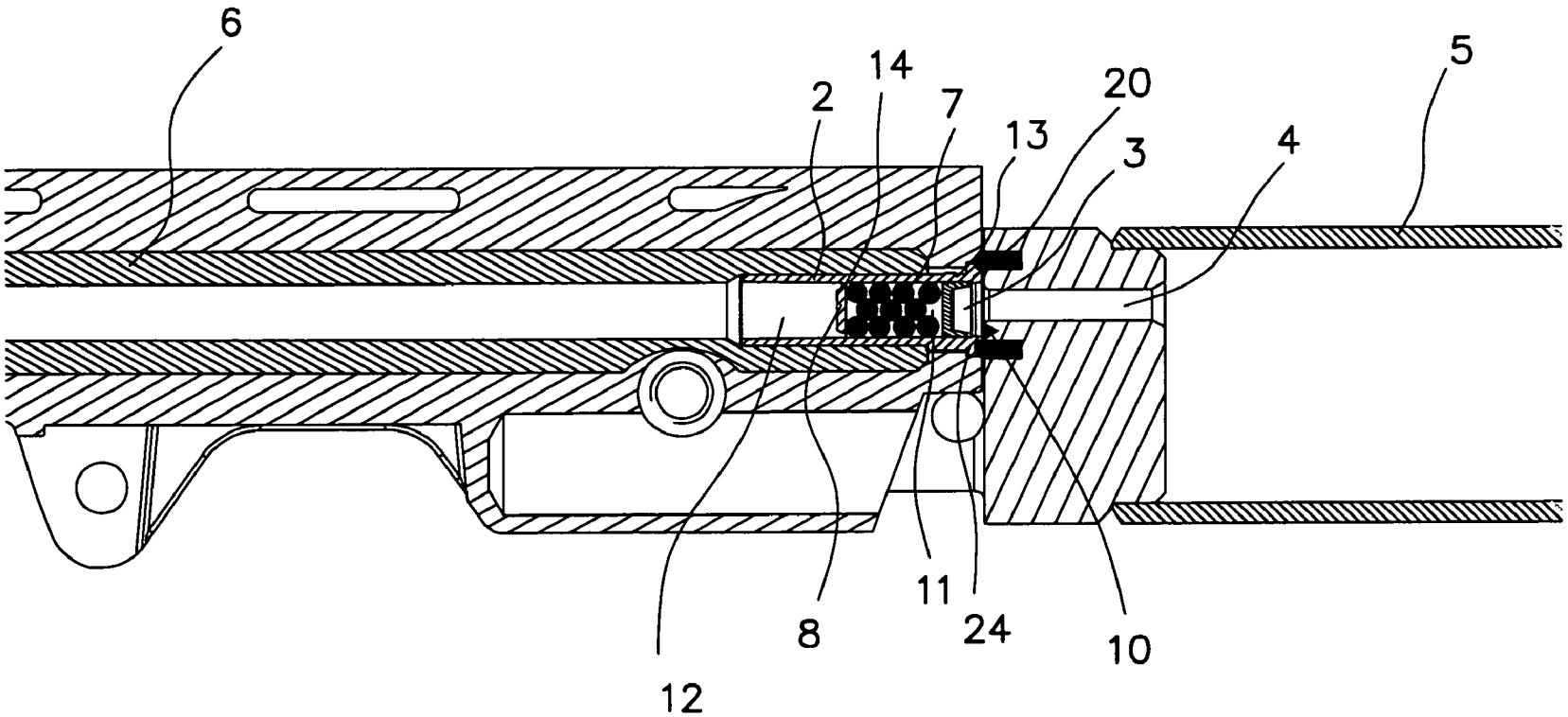
FIG. 2 is a sectional view taken along section line II-II of FIG. 1 with an un-fired pellet cartridge loaded in the firearm.
Figure 3:
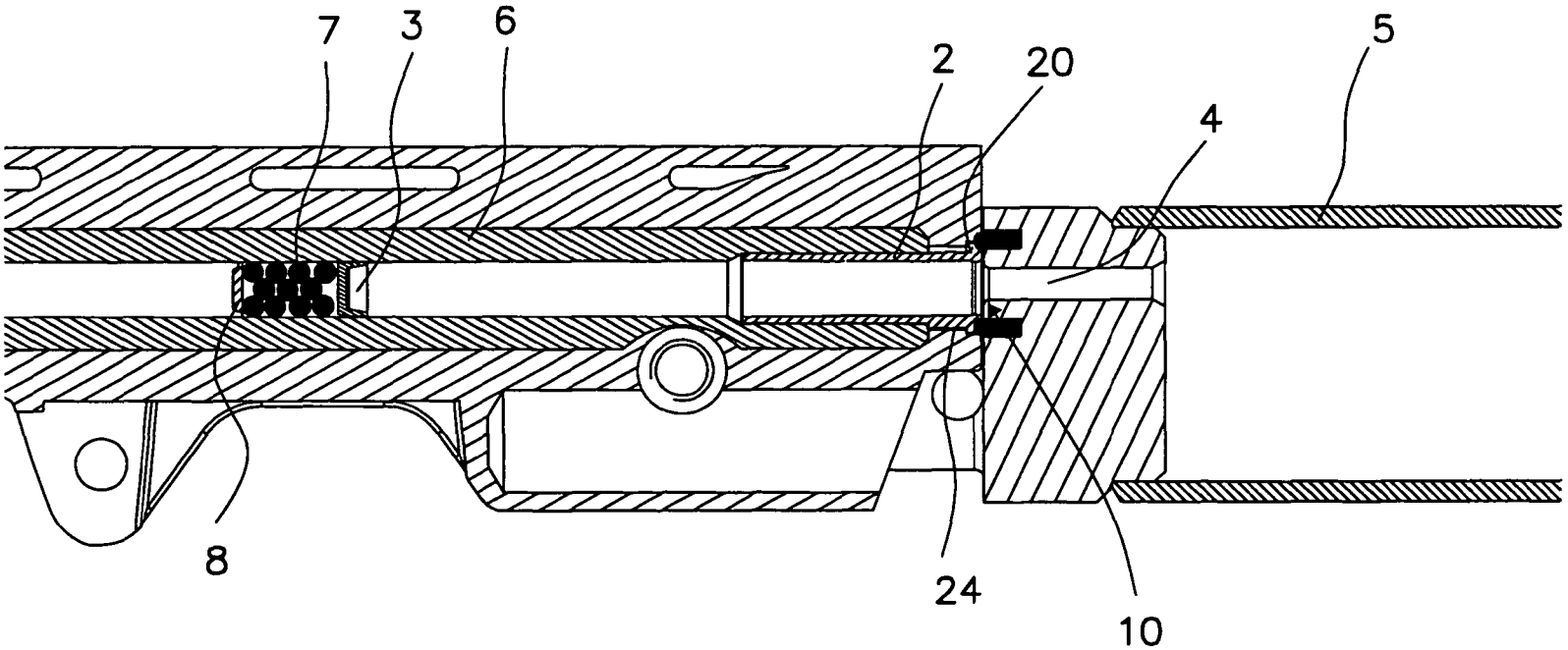
FIG. 3 is sectional view taken along section line II-II of FIG. 1 after the pellet cartridge has been fired.
Figure 4:
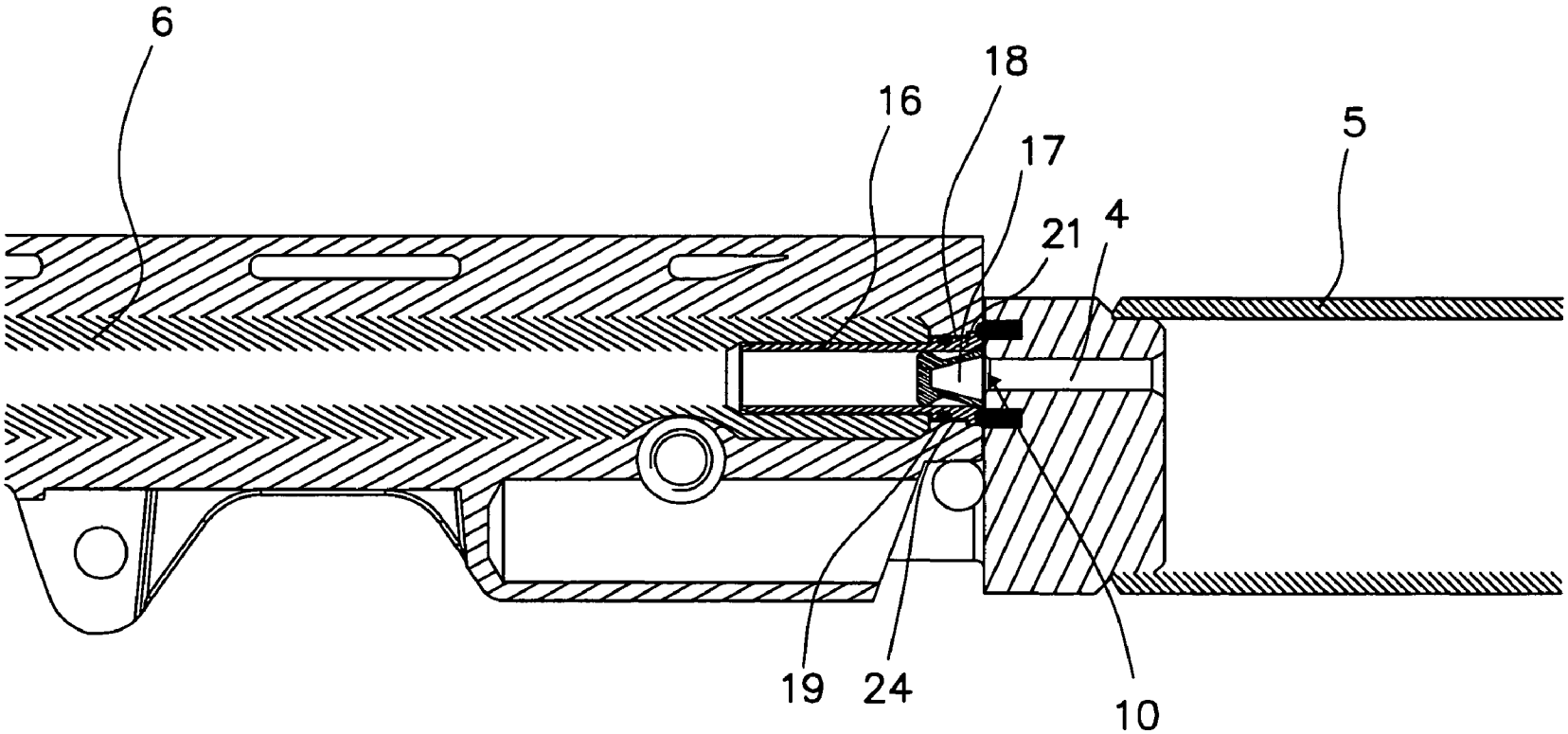
FIG. 4 is a sectional view taken along section line II-II of FIG. 1 showing the use of an adapter for firing a solid projectile.
Figure 10:
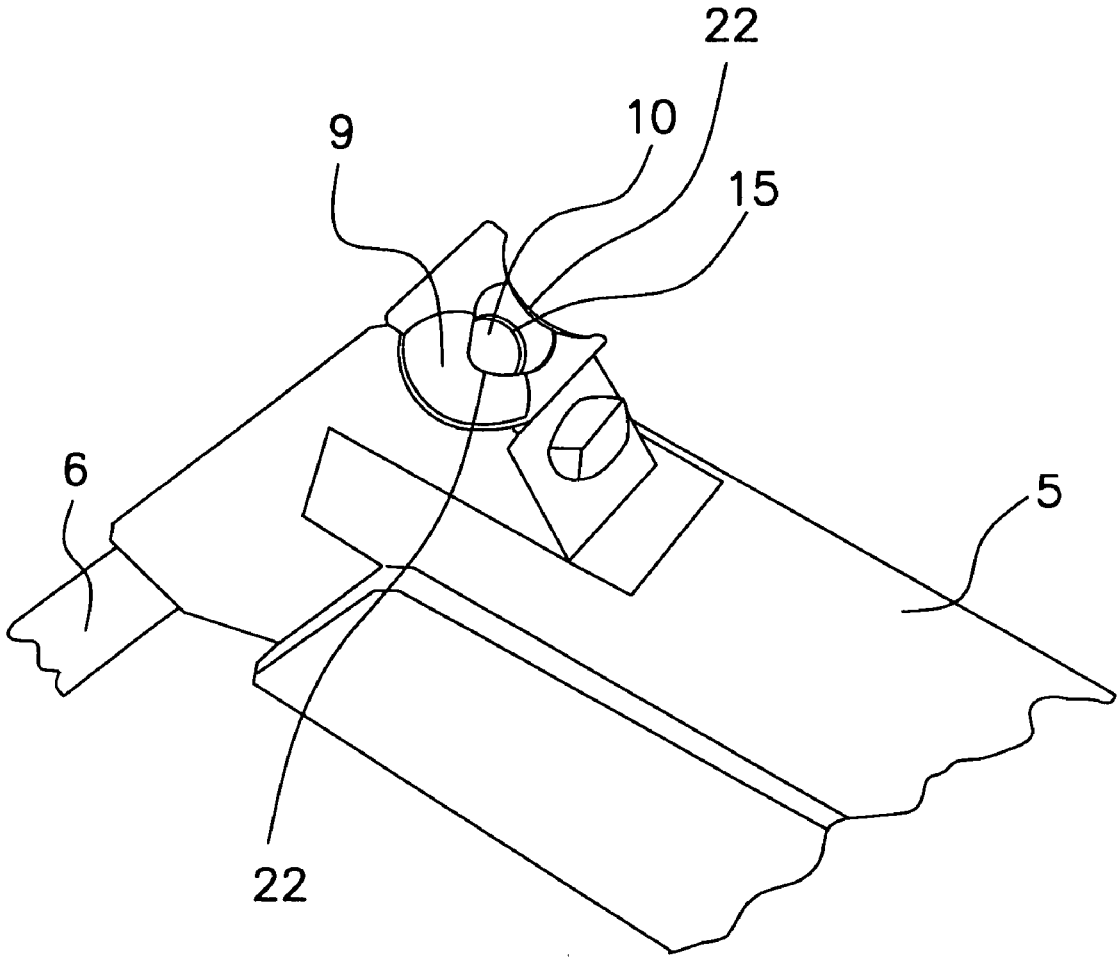
FIG. 10 is a partial perspective view of the firearm in an opened condition so that a pellet cartridge or an adapter and solid projectile can be loaded into or removed from the rifle.

FIG. 1 shows the barrel, trigger and butt portions of the firearm 1. The firearm 1, includes a butt 5 located behind the trigger and trigger guard. FIGS. 2-4 show cross sectional views, taken along section line II-II, which illustrate the interior mechanisms of the firearm As shown in FIG. 2, a pellet cartridge 2 can be loaded into the firearm. This would be accomplished by breaking open the firearm as shown in FIG. 10. The pellet cartridge 2 would be inserted into a hole 10 at the rear of the barrel. The barrel would then be closed back into the configuration shown in FIGS. 1 and 2.

Figure 5:
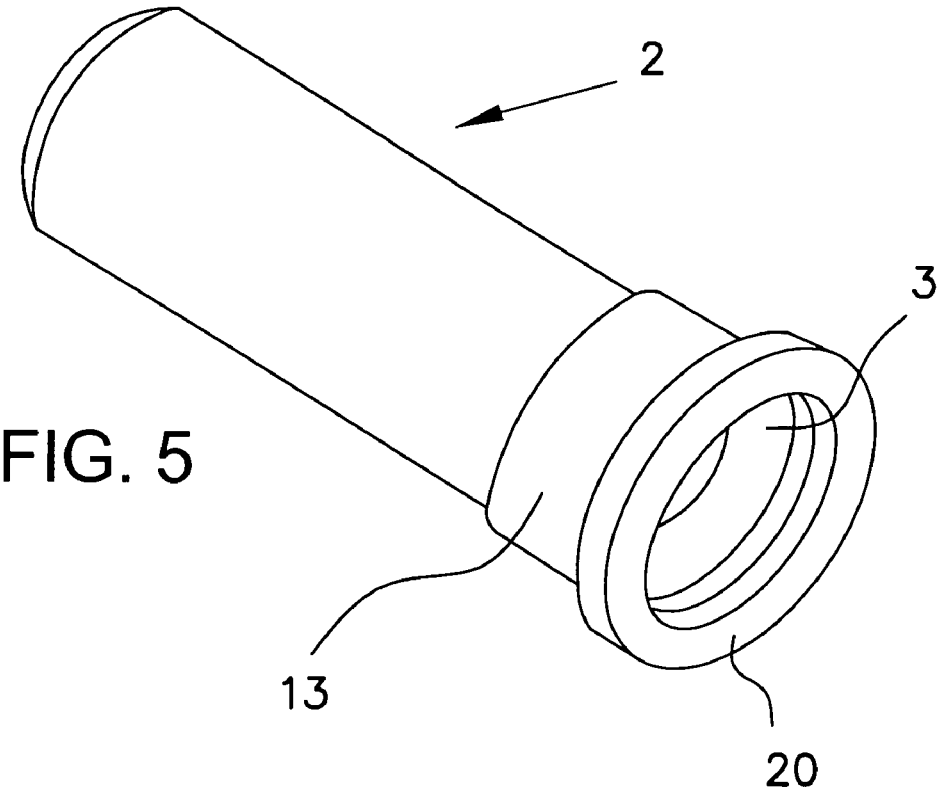
FIG. 5 is a top perspective view of a pellet cartridge.
Figure 6:
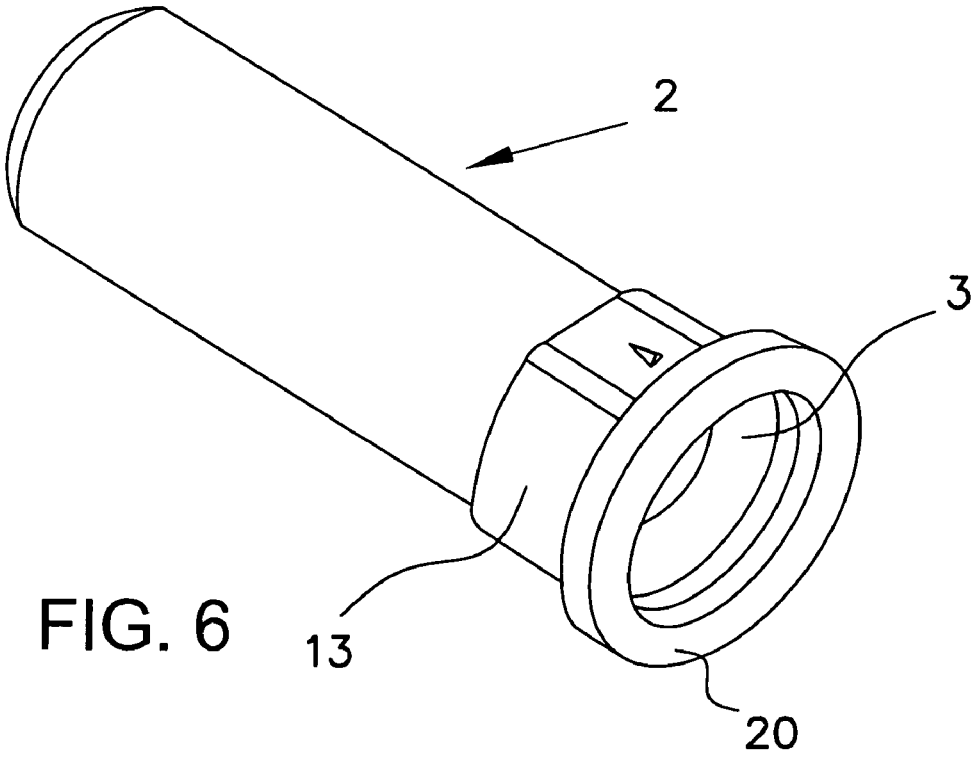
FIG. 6 is a bottom perspective view of the pellet cartridge shown in FIG. 5.
Figure 8:
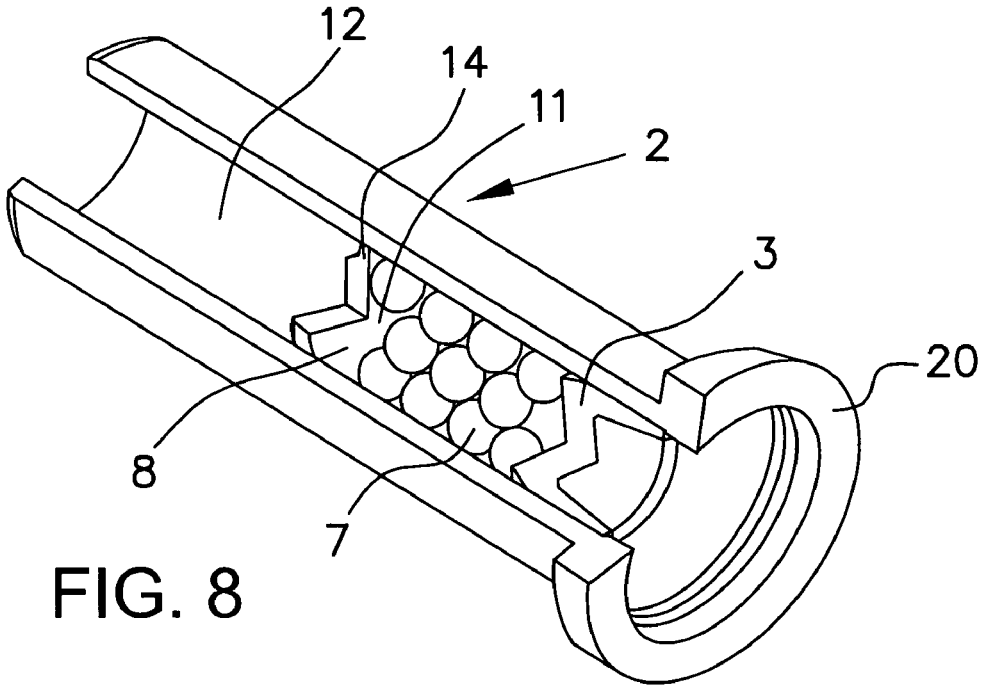
FIG. 8 is sectional perspective view of the pellet cartridge shown in FIG. 7 taken along section line VIII-VIII.

A typical cylindrical pellet cartridge, as shown in FIG. 8, includes a plurality of pellets 7 trapped between a rear cover 3 and a front cover 8. A rear hoop 20 is located at the back end of the cartridge 2 to limit the depth to which the pellet cartridge can be inserted into the barrel of the rifle. The front cover 8 divides the interior of the cartridge into a first space 11, where the pellets 7 are located, and a second space 12 at the front of the cartridge. In some embodiments, as shown in FIGS. 5 and 6, an expanded diameter cylindrical portion 13 is attached to the exterior rear of the cartridge.

A barrel 6 of the firearm ends at a widened portion 24 located at the end 10 of the barrel 6. The widened portion 24 could receive the rear hoop 20 of the pellet cartridge. The widened portion 24 may also be shaped to accommodate the expanded diameter cylindrical portion 13 of the pellet cartridge shown in FIGS. 5 and 6.

A compression chamber 4 is formed in the butt 5. Compressed gas in the compression chamber 4 is used to eject the pellets from the cartridge and down the barrel 6. When the firearm is fired, the compressed gas presses against the rear cover 3. The rear cover deforms and advances into the interior of the cartridge and presses the pellets forward against the front cover 8. The front and rear covers can be made of glass, plastic, paper or other suitable materials.

Figure 7:
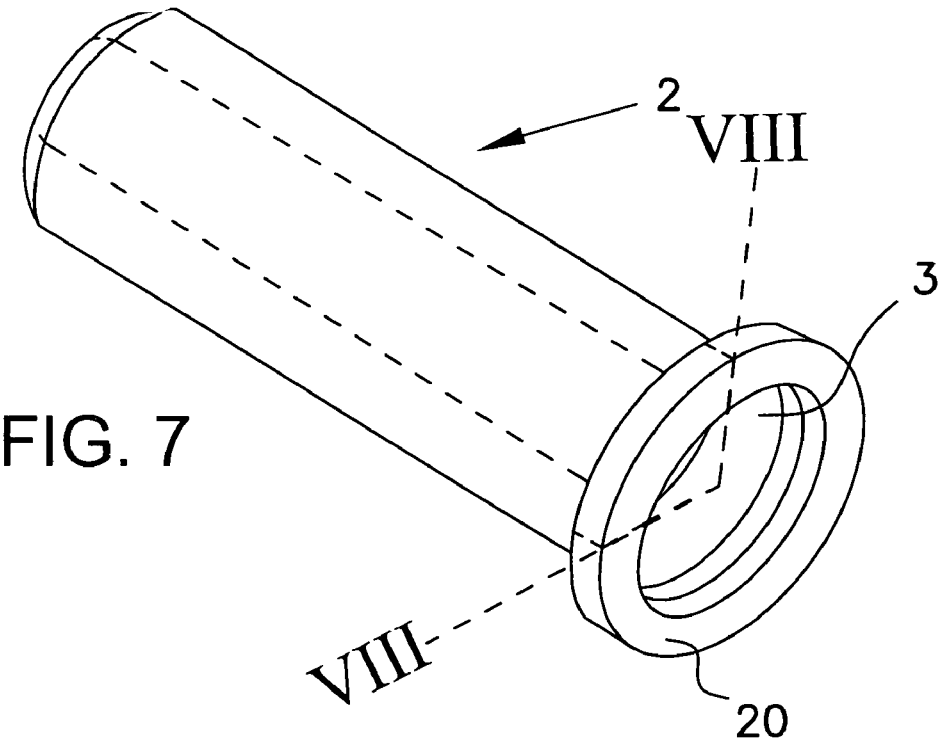
FIG. 7 is a top perspective view of another embodiment of a pellet cartridge.

In embodiments that do not use extremely large pressures, the cartridge shown in FIGS. 7 and 8 can be used. In other embodiments, where highly pressurized gas is used, a cartridge like the one shown in FIGS. 5 and 6 can be used. The pellet cartridge shown in FIGS. 5 and 6 includes the expended diameter outer portion 13 which acts to reinforce the cartridge. If the reinforcing were not used, the pressure of the gas could cause the rear end of the pellet cartridge to expand outwards. The exit speed of the pellets can average 180 m/s, depending on the pressure of the gas and the weight and size of the pellets.

Note, the front cover 8 is spaced back from the front edge of the cartridge. As a result, the front cover 8 separates the interior of the cylindrical cartridge into the first space 11 for receiving the pellets 7 and the second space 12. When the rifle is fired, the second space 12 guides the pellets 7 as they begin to move, and before they reach the interior of the barrel 6.

The movement of the pellets 7 also forces the front cover 8 to move down the length of the cartridge. Before the rifle is fired, the front cover 8 is attached to the interior cylindrical wall of the cartridge at two or more points 14. In preferred embodiments, the front cover is attached to the interior wall of the cartridge at three points. The attachment between the front cover and the cylinder acts to contain the pellets within the cartridge. But the front cover is also well attached to the cartridge so that a relatively large amount of pressure must build up behind the pellets before the front cover will break away and allow the pellets to travel down the barrel of the rifle. This helps to ensure that the pellets are ejected at a sufficiently high rate of speed.

The rear cover 3 also passes down the length of the cartridge when the rifle is fired. The movement of the rear cover down the length of the cartridge ensures that all of the pellets 7 within the cartridge are ejected. As shown in FIG. 3, when the rifle is fired, the front cover 8, pellets 7 and rear cover 3 all travel down the barrel and are ejected together. Because the pellets and front and rear covers travel down the barrel together, the pellets follow a substantially straight path down the barrel. This, in turn, tends to result in the pellets continuing to follow a straight path after they have been ejected from the barrel.

Once the rifle has been fired, and the user needs to replace the spent cartridge with a new one, the firearm is opened as shown in FIG. 10. Indentations 9 are formed on the rear of the barrel to make it easy for the user to grasp the left and right sides of the rear hoop 20 at the back of the cartridge. Notches 22 are cut into the larger indentations 9 to make it even easier for the user's fingers to get behind the rear hoop 20 of a cartridge to facilitate extraction of the cartridge from the barrel. The indentations 9 and notches 22 have a crescent shape, which corresponds to the shape of a user's fingers, to facilitate extraction of a cartridge 2.

Figure 9:
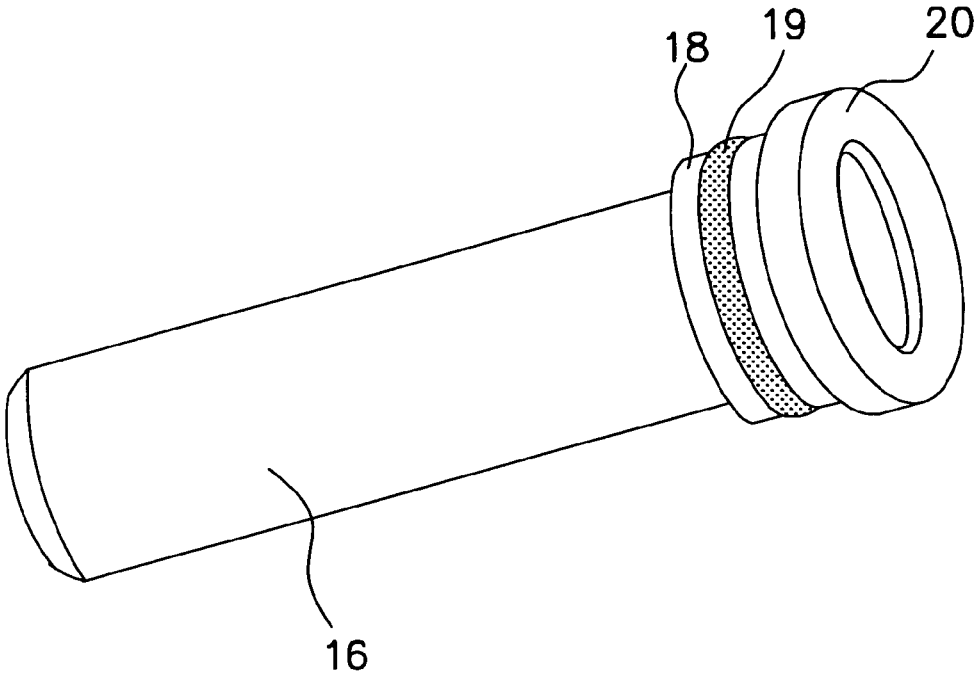
FIG. 9 is a perspective view of an adapter which can be used to fire a solid projectile.

As mentioned above, the rifle can also be used to fire solid projectiles using an adapter like the one shown in FIG. 9. To operate the firearm in this manner, the barrel would be opened as shown in FIG. 10 and the adapter 16 would be inserted into the barrel. As shown in FIG. 4, a slug-like projectile 17 would then be inserted into the adapter 16. The barrel would then be closed and would be ready to fire.

As with the pellet cartridges described above, the adapter could include an additional reinforcing portion 18 which would be accommodated by the widened portion 24 at the rear of the barrel 6. The front end of the adapter would be beveled to make it easier to insert the adapter into the barrel 6. Typically, the adapter would be made of metal or a metal alloy. The adapter 16 may also include an outer hoop 19 that would further improve its fixation in the interior of the barrel 6 to keep the adapter mounted within the barrel when the barrel is open.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of illustrative embodiments have been described, it should be understood that numerous other modifications and embodiments can be devised by those skilled in the art that will fall within the spirit and scope of the principles of this disclosure. More particularly, various variations and modifications are possible in the component parts and/or arrangements which would fall within the scope of the disclosure, the drawings and the appended claims. In addition to variations and modifications in the component parts and/or arrangements, alternative uses will also be apparent to those skilled in the art.

What is claimed is:

1. A combination compressed gas operated gun, projectile cartridge, and adapter, the gun comprising:

a butt;

a firing mechanism mounted in the butt and including a compression chamber which uses compressed gas to eject one or more projectiles; and a barrel that is pivotally mounted to the butt, wherein the barrel can be pivoted with respect to the butt to an open position at which the cartridge or adapter can be inserted into the barrel, and wherein the barrel can also be pivoted with respect to the butt to a closed position which brings a rear end of the cartridge or adapter in the barrel adjacent to the compression chamber such that compressed gas in the compression chamber can be used to eject the one or more projectiles from the cartridge or adapter and down the barrel;

wherein the end of the barrel adjacent the butt comprises a widened internal diameter portion;

the projectile cartridge comprising:

a first generally cylindrical outer shell comprising a first expanded diameter hoop on a rear of the cartridge, configured to be received in the widened internal diameter portion of the barrel to prevent the cartridge from moving down the barrel when the gun is fired;

a generally circular rear cover that is detachably mounted inside the rear of the cylindrical shell;

a generally cylindrical front cover that is detachably mounted inside the cylindrical outer shell such that a first space is formed between the front and rear covers; and at least a first one of the projectiles mounted in the first space, wherein the cartridge is configured such that when the cartridge is inserted in the gun, and compressed gas in the compression chamber is released to fire the gun, the front cover, rear cover and first projectile all separate from the outer shell and travel down the barrel;

the adapter comprising:

a second generally cylindrical outer shell comprising a second expanded diameter hoop on a rear of the adapter, configured to be received in the widened internal diameter portion of the barrel to prevent the adapter from moving down the barrel when the gun is fired; and a hollow, cylindrical interior extending the length of the adapter;

the adapter being configured for at least a second one of the projectiles to be placed in the interior by an end user such that the adapter holds the second projectile adjacent the compression chamber when the barrel is in the closed position such that compressed gas in the compression chamber can be used to fire the second projectile down the barrel;

wherein the adapter and the projectile cartridge are interchangeable with one another within the gun.

2. The combination of claim 1, wherein the gun further comprises at least one indentation in a rear end of the barrel to facilitate the removal of the cartridge or adapter from the barrel.

3. The combination of claim 2, wherein the at least one indentation is crescent shaped.

4. The combination of claim 2, wherein a notch is formed in the at least one indentation to further facilitate removal of a cartridge from the barrel.

5. The combination of claim 2, wherein the at least one indentation comprises first and second indentations formed on opposite sides of the rear end of the barrel.

6. The combination of claim 5, wherein a smaller notch is formed in each of the first and second indentations.

7. The combination of claim 1, wherein a front end of the adapter is beveled to facilitate insertion of the adapter into the barrel.

8. The combination of claim 1, wherein the adapter further comprises an expanded diameter reinforcing portion on an outer circumference of the adapter at a position adjacent the second rear hoop, wherein the expanded diameter portion serves to reinforce the adapter.

9. The combination of claim 8, further comprising a fixing portion on the expanded diameter portion, the fixing portion protruding out from the expanded diameter portion and acting to hold the adapter in the barrel.

10. The combination of claim 9, wherein the fixing portion forms a ring that protrudes out from the expanded diameter portion.

11. The combination of claim 1, wherein the front cover of the cartridge is mounted inside the cylindrical outer shell of the cartridge at an interim position down the length of the shell such that the front cover is spaced back away from a front end of the shell.

12. The combination of claim 1, further comprising at least two points of attachment between the outer edges of the front cover and the inner wall of the cylindrical shell of the cartridge.

13. The combination of claim 1, wherein the cartridge further comprises an expanded diameter reinforcing portion on an outer circumference of the shell at a position adjacent the first rear hoop, wherein the expended diameter cylindrical portion serves to reinforce the cartridge.

14. The combination of claim 1, wherein the first projectile is of a different type than the second projectile.

15. The combination of claim 1, wherein the first projectile comprises a plurality of projectiles.

16. The combination of claim 1, wherein the second projectile is exactly one projectile.

17. The combination of claim 1, wherein the first projectile comprises one or more pellets.

18. The combination of claim 1, wherein the second projectile comprises a slug.

19. A combination compressed gas operated gun, projectile cartridge, and adapter, the gun comprising:

a butt;

a firing mechanism mounted in the butt and including a compression chamber which uses compressed gas to eject one or more projectiles; and a barrel that is pivotally mounted to the butt, wherein the barrel can be pivoted with respect to the butt to an open position at which the cartridge or adapter can be inserted into the barrel, and wherein the barrel can also be pivoted with respect to the butt to a closed position which brings a rear end of the cartridge or adapter in the barrel adjacent to the compression chamber such that compressed gas in the compression chamber can be used to eject the one or more projectiles from the cartridge or adapter and down the barrel;

wherein the end of the barrel adjacent the butt comprises a widened internal diameter portion;

the gun further comprising at least one indentation in a rear end of the barrel to facilitate the removal of the cartridge or adapter from the barrel;

the projectile cartridge comprising:

a first generally cylindrical outer shell comprising a first expanded diameter hoop on a rear of the cartridge, configured to be received in the widened internal diameter portion of the barrel to prevent the cartridge from moving down the barrel when the gun is fired;

a generally circular rear cover that is detachably mounted inside the rear of the cylindrical shell;

a generally cylindrical front cover that is detachably mounted inside the cylindrical outer shell such that a first space is formed between the front and rear covers; and at least a first one of the projectiles mounted in the first space;

the adapter comprising:

a second generally cylindrical outer shell comprising a second expanded diameter hoop on a rear of the adapter, configured to be received in the widened internal diameter portion of the barrel to prevent the adapter from moving down the barrel when the gun is fired; and a hollow, cylindrical interior extending the length of the adapter;

the adapter being configured for at least a second one of the projectiles to be placed in the interior by an end user such that the adapter holds the second projectile adjacent the compression chamber when the barrel is in the closed position such that compressed gas in the compression chamber can be used to fire the second projectile down the barrel;

wherein the adapter and the projectile cartridge are interchangeable with one another within the gun.

20. The combination of claim 19, wherein the at least one indentation is crescent shaped.

21. The combination of claim 19, wherein a notch is foamed in the at least one indentation to further facilitate removal of a cartridge from the barrel.

22. The combination of claim 19, wherein the at least one indentation comprises first and second indentations formed on opposite sides of the rear end of the barrel.

23. The combination of claim 22, wherein a smaller notch is formed in each of the first and second indentations.

* * * * *

UNITED STATES PATENT AND TRADEMARK OFFICE

CERTIFICATE OF CORRECTION

PATENT NO. : 8,375,931 B2
APPLICATION NO. : 11/840049
DATED : February 19, 2013
INVENTOR(S) : Francisco Casas Salva It is certified that error appears in the above-identified patent and that said Letters Patent is hereby corrected as shown below:

Title Page, Item (54) and in the Specification, column 1, line 1, Title: Please replace "COMPRESSED GAS OPERATED FIREARM" with -- COMPRESSED GAS OPERATED AIRGUN --;

Title Page, Item (57) Abstract: Please replace "A compressed gas firearm is capable of firing either cartridges filed with pellets, or solid unitary projectiles. The firearm includes a barrel that is hinged to the butt so that cartridges or an adapter can be inserted into the end of the barrel." with -- A compressed gas airgun is capable of firing either cartridges filed with pellets, or solid unitary projectiles. The airgun includes a barrel that is hinged to the butt so that cartridges or an adapter can be inserted into the end of the barrel. --;

In the Specifications

In column 1, lines 6-8 please replace "The disclosure relates to a compressed gas operated firearm. More particularly, the disclosure relates to a firearm that is capable of firing pellets or a solid projectile." with -- The disclosure relates to a compressed gas operated airgun. More particularly, the disclosure relates to an airgun that is capable of firing pellets or a solid projectile. --;

In column 1, line 59 please replace "FIG. 1 is a partial perspective view of a firearm;" with -- FIG. 1 is a partial perspective view of an airgun; --;

In column 1, line 61 please replace "FIG. 1 with an un-fired pellet cartridge loaded in the firearm;" with -- FIG. 1 with an un-fired pellet cartridge loaded in the airgun; --;

In column 2, lines 9 please replace "FIG. 10 is a partial perspective view of the firearm in an" with -- FIG. 10 is a partial perspective view of the airgun in an --;

In column 2, lines 15-16 please replace "The firearm disclosed in this application can be used to file pellets or solid projectiles." with -- The airgun disclosed in this application can be used to file pellets or solid projectiles. --;

Signed and Sealed this
Twenty-eighth Day of May, 2013

Teresa Stanek Rea

Teresa Stanek Rea
*Acting Director of the United States Patent and Trademark Office*

In column 2, lines 17-18 please replace "When such a pellet cartridge is used, the firearm would operate much like" with -- When such a pellet cartridge is used, the airgun would operate much like --;

In column 2, line 21 please replace "The same firearm can also be used to fire solid projectiles." with -- The same airgun can also be used to fire solid projectiles. --;

In column 2, lines 23-25 please replace "The adapter would resemble a typical shotgun shell, and the adapter would be loaded into the barrel of the firearm in the same basic manner as the pellet cartridge." with -- The adapter would resemble a typical shotgun shell, and the adapter would be loaded into the barrel of the airgun in the same basic manner as the pellet cartridge. --;

In column 2, lines 26-28 please replace "FIG. 1 shows the barrel, trigger and butt portions of the firearm 1. The firearm 1, includes a butt 5 located behind the trigger and trigger guard." with -- FIG. 1 shows the barrel, trigger and butt portions of the airgun 1. The airgun 1, includes a butt 5 located behind the trigger and trigger guard. --;

In column 2, line 30 please replace "mechanisms of the firearm." with -- mechanisms of the airgun. --;

In column 2, lines 31-33 please replace "As shown in FIG. 2, a pellet cartridge 2 can be loaded into the firearm. This would be accomplished by breaking open the firearm as shown in FIG. 10.." with -- As shown in FIG. 2, a pellet cartridge 2 can be loaded into the airgun. This would be accomplished by breaking open the airgun as shown in FIG. 10. --;

In column 2, lines 47-48 please replace "A barrel 6 of the firearm ends at a widened portion 24 located at the end 10 of the barrel 6." with -- A barrel 6 of the airgun ends at a widened portion 24 located at the end 10 of the barrel 6. --;

In column 2, lines 55-57 please replace "When the firearm is fired, the compressed gas presses against the rear cover 3." with -- When the airgun is fired, the compressed gas presses against the rear cover 3. --;

In column 3, lines 35-37 please replace "Once the rifle has been fired, and the user needs to replace the spent cartridge with a new one, the firearm is opened as shown in FIG. 10." with -- Once the rifle has been fired, and the user needs to replace the spent cartridge with a new one, the airgun is opened as shown in FIG. 10. --; and In column 3, lines 47-50 please replace "To operate the firearm in this manner, the barrel would be opened as shown in FIG. 10 and the adapter 16 would be inserted into the barrel." with -- To operate the airgun in this manner, the barrel would be opened as shown in FIG. 10 and the adapter 16 would be inserted into the barrel. --.